US005445215A

United States Patent [19]

Herbert

[11] Patent Number: 5,445,215

[45] **Date of Patent: * Aug. 29, 1995**

[54] FAN ASSEMBLY WITH HEAT SINK

[76] Inventor: Edward Herbert, 1 Dyer Cemetery Rd., Canton, Conn. 06019-2029

[ * ] Notice: The portion of the term of this patent subsequent to Mar. 29, 2011 has been disclaimed.

[21] Appl. No.: 218,759

[22] Filed: Mar. 28, 1994

Related U.S. Application Data

[63] Continuation-in-part of Ser. No. 994,671, Dec. 22, 1992, Pat. No. 5,297,617.

[51] Int. Cl.[6] ..... F28F 13/12

[52] U.S. Cl. ..... 165/80.3; 165/125; 415/115; 415/178; 416/223 R; 361/697

[58] Field of Search ..... 165/80.3, 121, 122, 165/125, 185; 174/15.1, 16.1, 16.3; 257/721, 722; 361/694–697, 707, 709; 415/115, 178, 220; 416/223 R, 228, 210 R

[56] References Cited

U.S. PATENT DOCUMENTS

| | | | |
|---|---|---|---|
| 1,422,109 | 7/1922 | Lambert | 416/210 R |
| 1,940,318 | 12/1933 | Morse | 416/210 R |
| 2,162,152 | 6/1939 | Wulle | 165/125 |
| 3,285,328 | 11/1966 | Woodward | 165/121 |
| 4,253,799 | 3/1981 | Eichler | 416/210 R X |
| 4,513,812 | 4/1985 | Papst et al. | 165/121 X |
| 5,297,617 | 3/1994 | Herbert | 165/125 X |

FOREIGN PATENT DOCUMENTS

| | | | |
|---|---|---|---|
| 506945 | 9/1920 | France | 165/125 |

*Primary Examiner*—Martin P. Schwadron
*Assistant Examiner*—L. R. Leo

[57] ABSTRACT

Heat transfer from the inside of a fan duct to the air is very good because the air in this region has a high velocity and is turbulent due to the rotation of the fan blades. Devices mounted on the outside of the fan duct can thus be cooled effectively. The inside surface of the duct can be modified to enhance the heat transfer as by grooving it deeply. The fan blade also can be modified to increase the air velocity and the turbulence. External fins can be added to the fan duct, and it can be shrouded so that a portion of the exit air passes through the fins back to the inlet. This decreases the mass of the exit air, for quieter operation.

13 Claims, 3 Drawing Sheets

FAN ASSEMBLY WITH HEAT SINK

This is a continuation-in-part application for letters patent of "FAN ASSEMBLY WITH HEAT SINK", application Ser. No. 994,671, filed Dec. 22, 1992, U.S. Pat. No. 5,297,617; issue date: 29 Mar. 1994.

This invention relates to fan and heat sink assemblies as might be used for heat sinking semiconductor devices. Usually a fan is mounted so that it blows air over a heat sink assembly. The rate at which heat can be removed from the heat sink is a function of the heat sink surface area, the temperature difference between the heat sink and the air, and the velocity of the air. If the air has high velocity and is turbulent, the heat sink can be relatively smaller, but there are limitations to the extent that this is practical. It takes a large, powerful fan to move air with a high velocity. Such a fan would be expensive, would take substantial power to operate, and would be large and noisy.

This invention teaches that there is a region within a ducted fan where the air naturally has a very high velocity and is turbulent: the inside surface of the fan duct in the area swept by the fan blades. The fan blades move the air very rapidly, and also generate blade tip vortices and wake turbulence, so heat flow into the air stream is greatly enhanced. By mounting semiconductors or other devices needing heat sinking on the fan duct and in good thermal contact with it, a superior heat sink is achieved.

This invention further teaches several modifications to the fan blades to further enhance heat flow through the fan duct as a trade-off with fan performance as an axial flow device.

In the usual design of an axial flow fan, care is taken to provide the most efficient fan with respect to its usual function of moving air axially through the fan. In an inexpensive fan, this may be somewhat compromised in the interest of economy, but it is not disregarded. In contrast, the present invention is not particularly concerned with axial flow of air through the fan, and the fan blade design is optimized for maximum heat transfer from the fan duct to the air stream in the vicinity of the fan blade tips. Thus the fan blades may have a high pitch angle, and there may be more blades. The axial length of the blades may be longer, and the space between blades may be smaller. The flow of air may be restricted so that the fan operates in a stalled condition.

The fan blades may have such an exaggerated pitch that their function as an axial flow fan essentially ceases, they resembling more the blades of a centrifugal fan, although still enclosed by a fan duct. Circumferential air flow is then very high and axial flow only incidental. In some embodiments, axial air flow from the fan assembly may be entirely eliminated in favor of maximally enhancing heat transfer within the fan assembly.

This invention teaches that the fan blades may have appendages such as paddle bars at their tips, which decrease efficiency as an axial flow fan but which increase the air velocity and turbulence at the inside surface of the fan duct in the vicinity of the fan blade tips. The fan blades may be eliminated entirely in favor of the paddle bars, or the fan blades may remain only in vestigial form to provide a mere putt of axial air flow. The paddle bars may have the shape of an air foil.

Often the amount of air flow needed to transport the waste heat away from a heat sink is small compared to the amount of air flow that is needed to sustain sufficient air velocity for good heat transfer. Several embodiments of the invention teach that much of the air flow can be re-circulated within the fan assembly with heat sink to provide high air flow internally across the heat transfer surfaces while the inlet and exit air flow may be quite low, so that operation much quieter. This also greatly reduce the design requirements of accessories such as filters and finger guards which may be required on the inlet and/or outlet.

DESCRIPTION OF THE PREFERRED EMBODIMENTS

Figure 1:
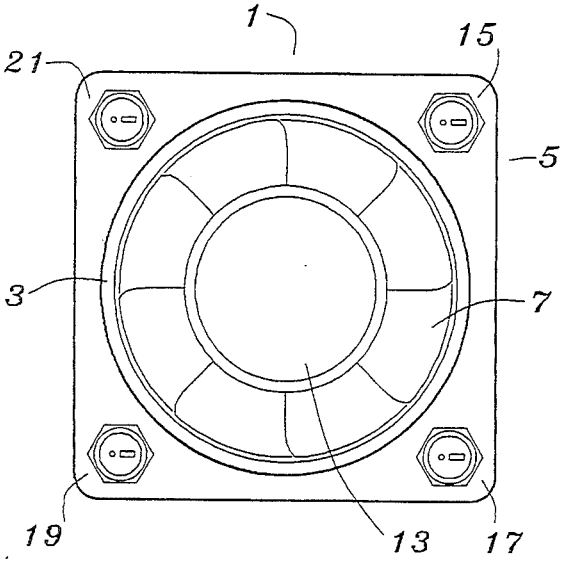
FIG. 1 shows an axial fan assembly of otherwise ordinary construction having a heat sink mounting flange for semiconductors. The heat sink mounting flange has a good thermal path to the inside surface of the fan duct where heat transfer to the air is enhanced by the high velocity and the turbulence of the air in the vicinity of the fan blade tips.

FIG. 1 show a front view of a fan assembly with heat sink 1. A fan 7 rotates within a fan duct 3 causing axial flow of air. A heat sink flange 5 for semiconductors 15, 17, 19, 21 is an integral part of, and an extension of the fan duct 3, and is preferably fabricated as by casting of a material having good thermal conductivity, such as aluminum. In many respects, the fan assembly 1 is an ordinary axial fan. The means by which the fan 7 is rotated is not material to the invention, but it may comprise a motor which may be located inside the hub 13 of the fan 7.

Heat from the semiconductors 15, 17, 19, 21 is conducted into the heat sink flange 5 and thence into the fan duct 3. The heat will then pass into the ambient air and surroundings by convection and radiation, to an extent, but heat transfer to the air is particularly effective at the inside surface of the fan duct 3 in the vicinity of the blade tips of the fan 7.

It is well known to those skilled in the art that the flow of heat from a heat sink to the ambient air is poor. The temperature of the air immediately adjacent to the heat sink rises rapidly nearly to the temperature of the heat sink surface, and tends to form a stagnant layer or "boundary" layer which tends to insulate the heat sink.

This insulating effect is reduced if a fan us used to move the air over the heat sink. Heat flow into the air improves as the air velocity is increased, particularly when the air velocity is high enough so that the air flow becomes turbulent.

The heat flow continues to improve as the velocity of the air is increased, but there are practical limits to which the air velocity can be increased in most applications. Large, powerful fans are expensive to acquire and operate, and tend to be very noisy. Thus for most applications a smaller quieter fan will be used, and the poorer heat conduction into the lower velocity air will be compensated for by using a larger heat sink.

There is a region in an axial flow ducted fan where the air flow has a very high velocity and is turbulent: the inside surface of the fan duct in the vicinity of the blade tips of the fan. As the fan rotates at a high speed, the air in the area swept by the blade tips of the fan will have a very high velocity and further will have a very complex flow due to blade tip vortices and so forth. As a consequence of this high velocity, turbulent air flow, heat conduction into the air is much enhanced in this region, and this phenomenon can be used to make an improved heat sink.

In the fan assembly of FIG. 1, heat sinking of the semiconductors 15, 17, 19, 21 is achieved through a simple modification of the fan duct 3 by adding the heat sink flange 5. This will result in some heating of the air as it passes through the fan 7, but otherwise the fan characteristics and performance are unaffected. The heat sink flange 5 is preferably integral to the fan duct 3, but it need not be. It could be provided as a separate accessory to be mounted as required. In this way, a variety of heat sinks could be offered or custom fabricated, and the mounting orientation could be varied for different applications. The inside surface of the fan duct 3 preferably is not coated with paint or any other material which would be an insulator.

The form and shape of the heat sink, shown as heat sink flange 5, is not central to the teachings of the invention, the heat sink flange 5 being used as a generalized illustration. Any mounting means for any device which needs heat sinking which can be made integral to or attached to the fan duct 3 and which provides heat conduction from the device to the inside surface of the fan duct 3 would be the functional equivalent of the heat sink flange 5. Heat flow can also be in the other direction, as for instance, to transfer heat from the air into the evaporator of a heat pump.

Figure 2:
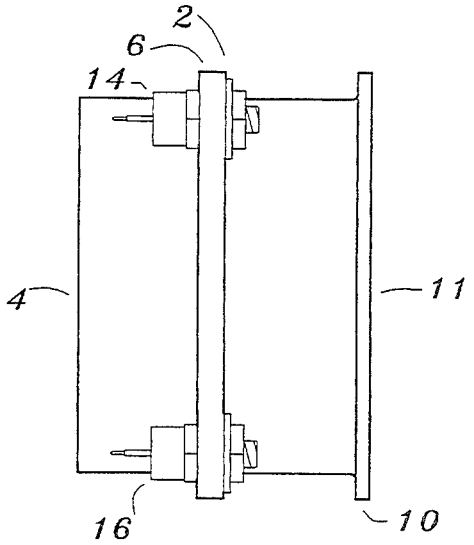
FIG. 2 is a side view of a fan assembly with heat sink, and shows a possible modification of the fan assembly with heat sink of FIG. 1, by having increased axial length.

FIG. 2 shows a side view of a fan assembly with heat sink 2. A heat sink flange 6 is integral to a fan duct 4 and may provide heat sinking for semiconductor devices 14, 16 or the like. The fan assembly with heat sink 2 may be mounted by a mounting flange 10. The fan may be driven by a motor 11 (hidden) inside the hub of the fan.

The relationship of FIGS. 1 and 2 will be immediately apparent, there being many common features. However FIG. 2 shows a fan assembly which is much longer axially than many axial flow fans in common use and so introduces one possible modification of the fan according to the teachings of this invention, which is discussed below with the discussion of FIGS. 7 and 8.

Figure 3:
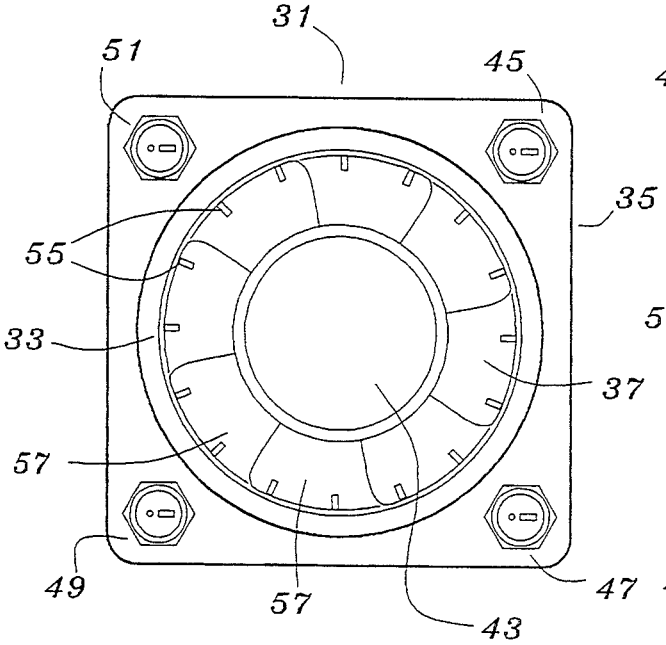
FIG. 3 is similar to the fan assembly of FIG. 1, but has modified fan blades.
Figure 4:
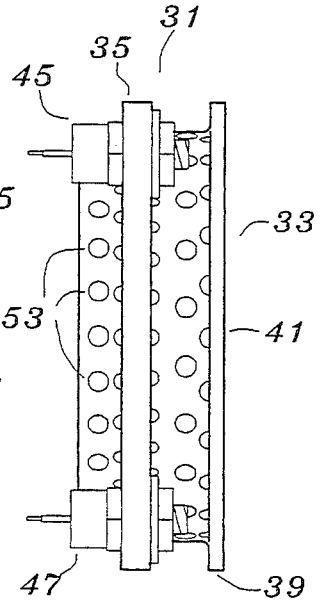
FIG. 4 is a side view of the fan of FIG. 3.

FIGS. 3 and 4 show other embodiments of the fan assembly with heat sink. FIG. 3 shows a front view and FIG. 4 shows a side view of a fan assembly 31. In many respects, the fan assembly 31 of FIGS. 3 and 4 is similar to the fan assemblies 1 of FIGS. 1. One difference is that the fan 37 may be modified by the addition of paddle bars 55—55 which are added to the tips of the blades 57—57 parallel to the axis of the fan assembly. The paddle bars 55—55 further agitate the air stream in the vicinity of the inside surface of the fan duct 33 to further enhance the heat transfer from the fan duct 33 to the air stream. The paddle bars 55—55 may be straight as shown, or they could be contoured as air foils. A plurality of holes 53—53 may be provided through the fan duct 33. The holes 53—53 may be radial as shown, or they may be tangential. The holes 53—53 are preferably staggered, and carefully located with respect to each other and the fan blades 57—57 and paddle bars 55—55 so that acoustic noise is canceled or at least not reinforced, so that a siren is not made inadvertently.

In FIGS. 3 and 4, semiconductors 45, 47, 49, 51 are mounted on a heat sink flange 35 which is an integral part of the fan duct 33. A fan 37 rotates within the fan duct 33. The fan 37 may be driven by a motor 41 (hidden) which may be located inside the hub 43 of the fan 37. A mounting flange 39 may be used to mount the fan assembly 31.

Figure 5:
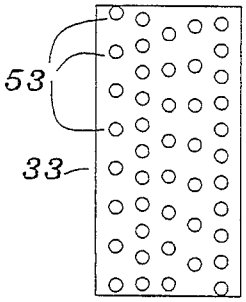
FIG. 5 is shows the inside surface of the fan of FIG. 4.

FIG. 5 shows a view of the inside surface of the fan duct 33 of the fan and heat sink assembly 31 of FIGS. 3 and 4. A plurality of through holes 53—53 are staggered with a controlled randomness so that the fan blades 57—57 and the paddle bars 55—55 do not pass by holes 53—53 at the same instant. This is so that an inadvertent siren will not be created. As the fan blades 57—57 and the paddle bars 55—55 pass the holes 53—53, there will be an increased fluid pressure in front of the fan blades 57—57 and/or paddle bar 53—53 and a decreased fluid pressure behind them. This will cause an acoustical wave front which will propagate through the holes 53—53. Preferably the holes 53—53, the fan blades 57—57 and the paddle bars 55—55 are arranged and disposed so that the acoustical waves will cancel to the extent possible.

Figure 6:
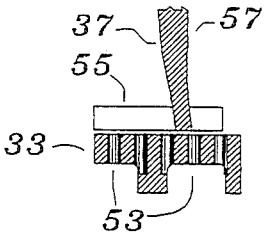
FIG. 6 shows a section through the fan duct wall and a fan blade of the fan of FIG. 3, and shows a paddle bar at the tip of the fan blade.

FIG. 6 shows a section through the fan duct 33 of the fan assembly with heat sink 31 of FIGS. 3 through 6 showing the holes 53—53, a section through one of the fan blade 57 of the fan 37, and a side view of one of the paddle bars 55.

With reference to FIGS. 3 and 6, the paddle bars 55—55 further accelerate the air around the inside of the fan duct 33, performing in a manner of speaking like the blades of a centrifugal fan. The air tends to leave the paddle bars 55—55 tangentially, but it is captured by the fan duct 33 and is constrained so that most of it circulates circumferentially therein.

Optionally, a plurality of holes 53—53 may penetrate the fan duct 33. The holes 53—53 may be radial as shown, or they may be tangential to align with the natural direction of air flow leaving the paddle bars 55. The inside surface of the holes 53—53 provides additional surface for heat transfer, and the air passing through the holes 53—53 will have a high velocity and will be turbulent. Tangential holes would tend to be longer, and so would have more inside surface area if of equal diameter. The holes need not be round as shown, but could have a cross-section with increased surface area such as a star or snow-flake, for greater heat transfer.

"Fan performance" in its usual sense would be better without the paddle bars 55—55 or the holes 53—53. In improving the heat sinking capacity of the fan assembly 31, a compromise in its performance as an axial flow fan is accepted. Either the axial air flow through the fan will be reduced or the fan and motor will have to be increased in performance to compensate for the increased friction, blade tip losses and/or bleed air lost through the holes 53—53. For many applications, the ability to heat sink components through the fan duct 33 will more than compensate for the reduction in the fan performance. Not only may a separate heat sink be eliminated, resulting in a smaller, lighter, more compact package, but the reduced performance as a fan may result in lower air noise because of the reduced velocity and mass of the exit air.

It is to be understood that FIGS. 1 through 6 show a number of enhancements to the invention, and any or all of them may or may not be used in any possible combination. In most instances the use of one feature does not depend upon the use of another. To further illustrate this point, the use of the holes 53—53 to increase the heat sinking is entirely independent of the use of the paddle bars 55—55, and in various applications one or the other or neither or both might be used.

Figure 7:
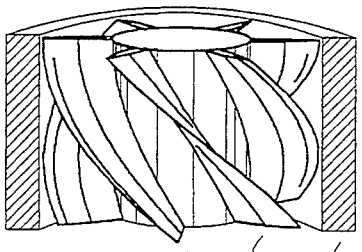
FIG. 7 shows the fan of the fan assembly with heat sink of FIG. 2. The axial length of the fan is relatively long and the pitch of the fan blades is very steep.

FIG. 7 shows a fan 61 having fan blades 63—63 which rotates in a fan duct 65. This fan incorporates several design features which would enhance its performance in a fan assembly with heat sink although compromising its performance as an axial flow fan. These design features are explained below in contrast to FIG. 8.

Figure 8:
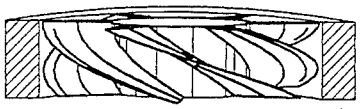
FIG. 8 shows the fan of the fan assembly with heat sink of FIG. 1, configured as is more usual in an axial flow fan, having a relatively short axial length and a relatively shallow pitch of the fan blades as compared to the fan blades of FIG. 7.

FIG. 8 shows a fan 67 having fan blades 69—69 which rotates in a fan duct 71. As compared to the fan 61 of FIG. 7, the fan 67 of FIG. 8 has features which are optimized for best axial air flow. The fan blades 69—69 have a modest pitch and the area of the fan duct 71 swept by the tips of the fan blades 69—69 is minimized.

The fan 61 of FIG. 7, by usual criteria of fan performance, would be a very poor fan. The pitch of the fan blades 63—63 is very steep, so much so that the angle of attack is extreme and the blades will certainly be stalled. As is well known in the art of fan design, when a fan stalls, its operation as an axial flow fan is very inefficient and air flow through the fan will be low. For a fan with heat sink assembly of this invention, operating in a stalled condition can be beneficial, as it reduces the load on the drive motor. Reducing axial air flow can be beneficial further in lowering the fan noise. The increased axial length of the fan 61, the fan blades 63—63 and the fan duct 65 is also detrimental to its operation as an axial flow fan, as it increases the drag caused by blade tip losses and vortices. For a fan with heat sink assembly of this invention, it is beneficial, as it greatly increases the area from which heat is transferred to the air.

Thus this invention teaches that the inside surface of the duct of an axial flow fan is a superior heat sink surface in a fan of ordinary design. It further teaches that the design of the axial flow fan can be modified by increasing the pitch and/or the length of the fan blades to further improve the heat transfer to the air in the fan duct. The parent of this continuation-in-part application teaches that the inside surface of the fan duct may have textural features to improve further the heat transfer from the inside of the fan duct to the air, the holes 53—53 of FIGS. 4 through 6 being one example.

Figure 9:
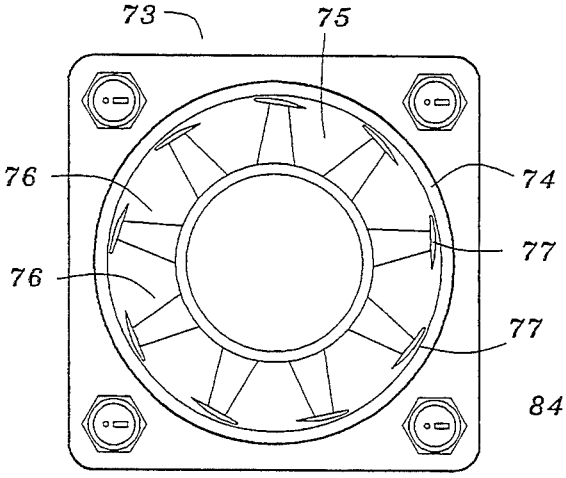
FIG. 9 shows a fan assembly with heat sink in which the fan blades have been eliminated in favor of paddle bars having the shape of an air foil.

FIG. 9 shows a fan with heat sink assembly 73 having a fan duct 74 enclosing a fan 75. The fan comprises a plurality of spokes 76—76 carrying a plurality of bars 77—77 which are shaped as air foils. The spokes 76—76 may be vestigial fan blades, and may have a slight pitch to provide some axial air flow, but their primary function is to support and rotate the bars 77—77.

The bars 77—77 are shaped as air foils, and for anti-clockwise rotation, the angle of attack of the air foils is such that air flowing over the air foil has increased velocity and reduced pressure over the outer surface, the surface closest to the inside wall of the fan duct 74. This region of increased velocity and reduced pressure follows the bars 77—77 around the inside surface of the fan duct 74 as the fan rotates at high speed, periodically subjecting any particular incremental arc of the fan duct to air having increased velocity and reduced pressure. Before and after the bars 77—77 pass the incremental arc, the air is at ambient pressure and has a relatively lower but still at quite high velocity as it is swept around by the rotation of the fan 75. This causes a pulsating scrubbing action which breaks down and dissipates the boundary layer, so heat transfer is improved.

The space between the air foil shaped bars 77 and the inside surface of the fan duct 74 is like a venturi, moving around the inside surface of the fan duct 74 at high speed. As the air passes through this venturi, the area through which the air passes is first reduced, then expanded. This creates a region of reduced pressure. As the air foil passes, eventually the air will separate, resulting in a wake turbulence, which further scrubs the inside surface of the fan duct 74, also increasing heat transfer from the fan duct 74 to the air passing through the fan with heat sink 73.

FIG. 9 illustrates the bars 77—77 as well formed air foils, but a good approximation could be fabricated of metal stampings. Spokes are not necessary if an alternative means of support is provided. The familiar "squirrel-cage" fan of some centrifugal blowers comes to mind. A similarly formed "Squirrel-cage" assembly installed in a fan duct as the fan assembly 75 is installed in the fan duct 74 would work well in this invention.

Figure 10:
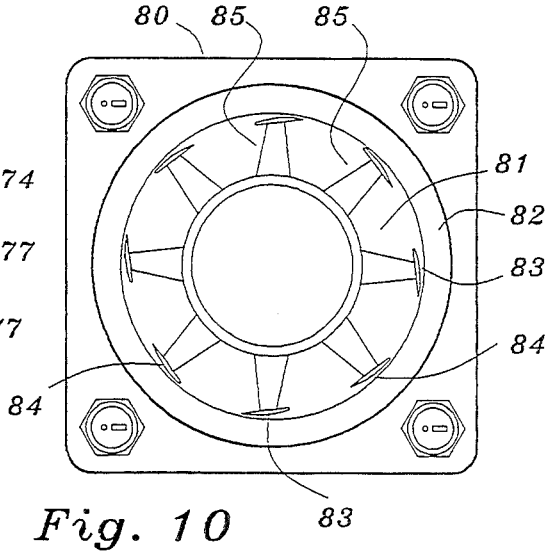
FIG. 10 shows a fan assembly with heat sink having paddle bars in the shape of an air foil. Alternate paddle bars have opposite angles of attack.

FIG. 10 shows a fan assembly with heat sink 80 having a a fan 81 rotating within a fan duct 82. The fan 81 comprises a plurality of paddle bars 83—83 and 84—84. One set of paddle bars 83—83 comprises airfoils having a positive angle of attack for anti-clockwise rotation and a second set of paddle bars 84—84 comprises airfoils having a negative angle of attack for anti-clockwise rotation. All of the paddle bars 83—83 and 84—84 are mounted on spokes 85—85, which may be vestigial fan blades and may have a slight pitch to effect a modest axial flow, but their primary function is to support and rotate the paddle bars 83—83 and 84—84.

In either fan assembly with heat sink 73 or 80, there is a large radial dynamic force on the individual paddle bars, but in each case it is balanced by equal and opposite radial dynamic forces on the opposite side of the fan so that the net radial load on the fans 75 or 81 is nil.

A similar function could be accomplished with sets of airfoils like a helicopter rotor rotating in a plane above a flat plate, or with airfoils rotating on the outside of a cylinder.

In FIG. 10, the fan duct 82 is shown having a thickened wall thickness. This could be to allow the inside surface of the fan duct to have surface features to enhance heat transfer to the air stream as taught in the parent patent (U.S. Pat. No. 5,297,617) to this continuation-in-part application. It might be thick just to improve heat flow from the heat sink mounting surface to the extremities of the fan duct. These are design trade-offs which would be part of the design process, and would be understood by one familiar with the art.

Figure 11:
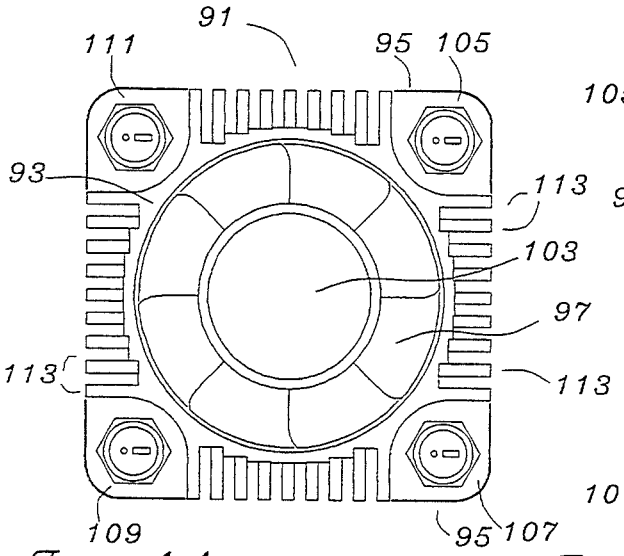
FIG. 11 is similar in many respects to the fan assembly with heat sink of FIG. 1, but in addition it has a plurality of fins cast integral to the fan duct.
Figure 12:
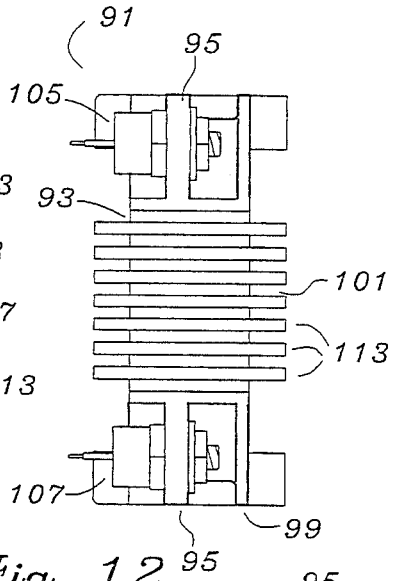
FIG. 12 is a side view of the fan assembly with heat sink of FIG. 11.
Figure 13:
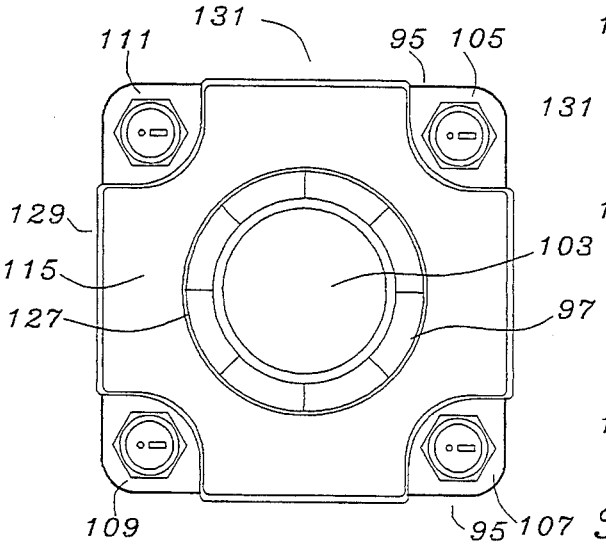
FIG. 13 is the fan assembly with heat sink of FIG. 11 having a shroud covering a portion of the fan exit, directing the air outward and back over the fins.
Figure 14:
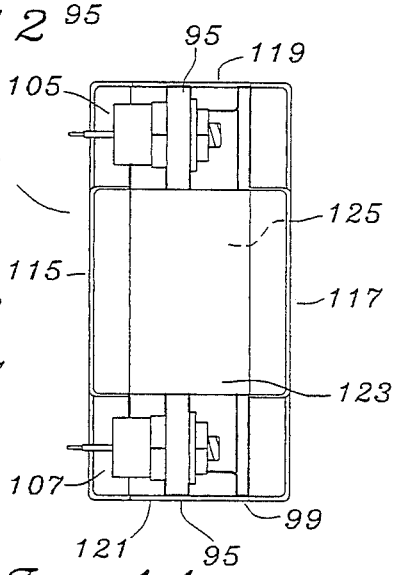
FIG. 14 is a side view of the fan assembly with heat sink of FIG. 13, showing that the fins are also shrouded on the sides and the inlet end, so that a portion of the air from the fan is directed outward and back over the fins to the inlet, to increase the transfer of heat to the air within the fan assembly with heat sink. The volume of the inlet and outlet air flow is reduced, for quieter operation.

FIGS. 11 through 14 show another embodiment of the fan assembly with heat sink. The fan assembly with heat sink 91 of FIGS. 11 and 12 is a sub-assembly of a larger assembly, shown here to illustrate certain internal features. The fan assembly with heat sink 131 of FIGS. 13 and 14 is the fan sub-assembly 91 of FIGS. 11 and 12, but shrouded.

FIG. 11 shows a front view and FIG. 12 shows a side view of a fan assembly with heat sink 91 which in many respects is similar to the fan assembly with heat sink 1 of FIGS. 1. A fan 97 rotates within a fan duct 93. Integral to the fan duct 93 is a heat sink mounting flange 95 for mounting semiconductors 105, 107, 109, 111. The fan 97 may be driven by a motor 101 (hidden) which may be located inside the fan hub 103. The fan sub-assembly 91 may be mounted by a mounting flange 99.

Integral to the fan duct 93 and the heat sink flange 95 are a plurality of fins 113—113.

The fan assembly with heat sink 131 of FIGS. 13 and 14 comprise all of the elements of the sub-assembly 91 of FIGS. 11 and 12, and further comprises a shroud 129. The shroud 129 comprises a front cover 115, a rear cover 117 and four side covers 119, 121, 123, 125 (hidden, on the far surface). The shroud 129 mostly blocks the outlet 127 of the fan 97, capturing a large part of the axial air flow, redirecting it back within the fan assembly 131 over the plurality of fins 113—113 and back to the inlet of the fan. The inside of the fan duct 93 may or may not have special features to enhance heat flow.

Among the criteria used to determine the selection of a fan for fan and heat sink assemblies are two considerations regarding the mass of the air flow and the velocity of the air flow: The first is the mass of air that must be moved to transport the waste heat from the heat sink assembly. This is a factor of the specific heat of the air, the acceptable air temperature rise and the quantity of heat to be removed. Often, a modest exchange of air is sufficient to accomplish this. The other consideration is the velocity of air passing over the heat sink assembly necessary to have satisfactory heat transfer from the surface of the heat sink through the boundary layer into the air stream. This is a factor of the surface area of the heat sink, the acceptable temperature rise of the heat sink and the quantity of heat to be removed. Often, the amount of air that must be moved to transport the heat away from the heat sink assembly is small compared to the amount of air that must be moved to sustain the requisite air velocity over the heat sink assembly.

In the fan assembly 131 of FIG. 13, the fan outlet 127 in the shroud 129 can be sized so that the exit air is only that mass of air which is necessary to transport the waste heat away from the assembly. The rest of the air can be re-circulated within the fan assembly 131, with a velocity far higher than would usually be practical with separately mounted fan and heat sink assemblies. Not only does this fan assembly 131 take advantage of the improved heat transfer in the vicinity of the blade tips of the fan 97 but it also integrates additional heat sink features and completely contains the high velocity air stream. This will result in a compact, light weight self contained fan and heat sink assembly which also will be very quiet.

The outlet 127 of the shroud end cap 115 is preferably formed to extend inward nearly to the face of the fan 97. The inlet (not visible) in the shroud end cap 117 can be similarly formed. This has the effect of capturing most of the air flow and pressure of the fan 97, the remaining exit air being mostly from the blade roots. The air passages between the fins 113-113 and the general shape and arrangement of the air flow path can be optimized along with the design of the fan 97 to provide the best trade-off of back pressure for the fan, air flow, blade tip vortices and losses and so forth for optimum performance to maximize the flow of heat from the fan assembly with heat sink. If necessary for the outlet pressure to be maintained, the outlet 127 can be made smaller or other wise restricted with baffles, aperture plates or whatever.

Often it is necessary to provide accessories on the inlet an/or outlet of a fan assembly, such as finger guards, EMI filters, particulate filters, acoustic noise filters and so forth. In the fan assembly 131 of FIGS. 13 and 14, the air flow entering and exiting the fan assembly 131 is much reduced so these accessories can be designed for the much reduced net air flow. This will allow them to be smaller, simpler and more effective.

The fan assembly 131 can be designed so that more or less air is re-circulated and less or more air is carried through the fan assembly 131. This is a design trade off which would be understood by one skilled in the art. For some applications, the flow may be almost entirely internalized. For others, there may need to be significant air flow for other components, so more of the characteristics of a conventional axial flow fan may be retained by re-circulating less air.

Figure 15:
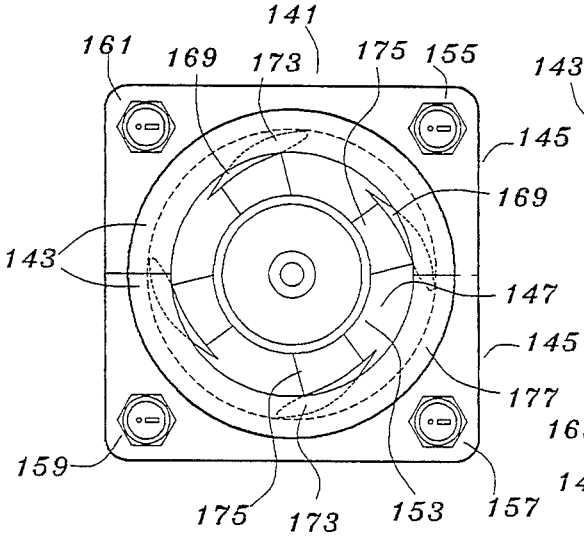
FIGS. 15 through 17 show a fan assembly with heat sink having a heat sink mounting surface for semiconductors. The impeller has paddle bars shaped as air foils. As shown in phantom and in the sectional views, the air foil is partially segmented, and scoops into peripheral grooves.
Figure 17:
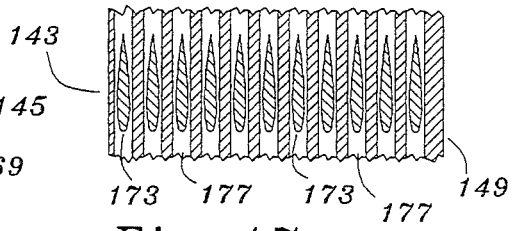
Figure 16:
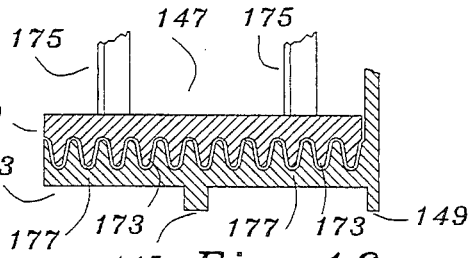

FIGS. 15 through 17 show another embodiment of the invention. FIG. 15 shows a front view of a fan assembly 141. A fan 147 rotates within a fan duct 143—143. Integral to the fan duct 143—143 is a heat sink mounting flange 145—145 for mounting semiconductors 155, 157, 159, 161. As shown in phantom in FIG. 15 and in the sectional views of FIGS. 16 and 17, the fan 147 further comprises paddles 169—169 mounted upon spokes 175—175. The paddles 169—169 are generally shaped as airfoils, and further comprise appendages 173—173 to the paddles 169—169 which scoop into grooves 177—177 in the inside surface of the fan duct 143—143.

The fan duct 143—143 is necessarily in two parts because it must be assembled around the fan 147, the appendages 173—173 making it impossible to slip in axially during assembly.

FIG. 16 shows a radial cross section through the fan duct 143—143 of the fan assembly with heatsink 141 of FIG. 15 showing that the appendages 173—173 of the paddles 169—169 fit closely into the grooves 177—177 in the fan duct 143—143. The fan assembly with heat sink 141 may be mounted by a mounting flange 149. The spokes 175—175 of the fan 147 may have a slight pitch to provide some axial air flow.

It is readily apparent from the section of FIG. 16 that employing grooves 177—177 in the fan duct 143 greatly increases the surface area of the fan duct 143 for a given axial length.

FIG. 17 shows a tangential cross section through the fan duct 143—143 of the fan assembly with heatsink 141 of FIG. 15 showing that the appendages 173—173 have the shape of airfoils in their tangential section. The appendages 173—173 fit into grooves 177—177 in the fan duct 143—143.

Figure 18:
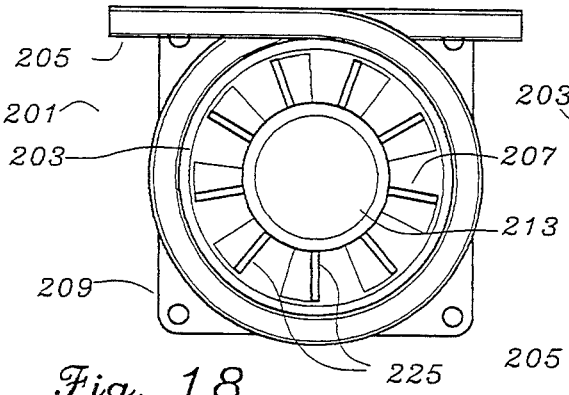
FIG. 18 shows a fan assembly with heat sink having a conduit for a fluid. The impeller has blades with a slight twist to provide a small axial flow component, but only the front side is open, so no axial flow is provided. As shown, the bias of the impeller urges air into the fan for anti-clockwise rotation, but it cannot escape, resulting in increased pressure which increases the "leakage" at the blade tips. This increases the velocity of the air in the vicinity of the blade tips and increases the blade tip vortices. Some air will spill away, and some will be re-circulated.

FIGS. 18 through 21 show another embodiment of the invention. FIG. 18 shows a front view of a fan assembly with heat sink 201. A fan 207 having a plurality of fan blades 225—225 rotates in a fan duct 203. A fluid conduit 205 is wrapped around the fan duct 203 and preferably is bonded to it with a bonding means having good thermal conductivity such as braze or solder.

Figure 19:
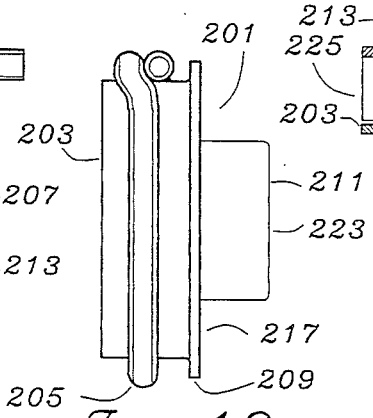
FIG. 19 shows a side view of the fan assembly with heat sink of FIG. 18.

FIG. 19 shows a side view of the fan assembly with heat sink 201 of FIG. 18. The fan 207 may be driven by a motor 211 (hidden) within a motor cover 223 mounted on the rear wall 217 of the fan assembly with heat sink 201. A mounting flange 209 may be used to mount the fan assembly 201.

Figure 20:
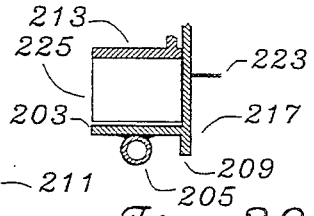
FIG. 20 shows a section through the fan duct and a side view of one of the impeller blades in the fan assembly with heat sink of FIG. 18.

FIG. 20 shows a section 217 through the fan duct 203, the fluid conduit 205, the mounting flange 209, the rear wall 217, part of the motor cover 223 and part of the fan hub 213, and also shows a side view of a fan blade 225.

Fluid having a temperature higher or lower than the ambient air can be circulated in the fluid conduit 205. Heat will flow from the fluid conduit 205 into the fan duct 203 and then into the air stream, or vice versa.

The fan blades 225—225 are nearly straight, and could be straight. As shown, the fan blades 225—225 have a slight twist, which would cause the air flow to have a slight axial flow component into the fan assembly 201 for anti-clockwise rotation, but the primary air flow is outward, due to centrifugal force. The air would tend to leave the fan 207 tangentially, but it is captured by fan duct 203 and constrained so that most of the air flows circumferentially at high velocity around the inside of the fan duct 203.

As shown, the fan assembly 201 has no axial air flow outside of the fan assembly 201, and within the fan assembly 201, air is drawn in at the center of the fan hub 213 and given a slight axial component to draw the air deeper into the fan assembly 201. Once the air passes through the fan 207, most of it circulates circumferentially within the fan duct 203 but part of the air would spill back out of the fan assembly 201. Some of the air will be drawn back into the fan assembly 201, and some of it will mix with the surrounding air and be dissipated. A partial baffle on the open side of the fan assembly could be used to increase the amount of re-circulation of the air.

An alternative embodiment of the fan assembly 201 of FIGS. 18 through 21 could be made by providing exit openings through the rear wall 217. When so modified, the fan assembly would have some axial air flow, which could be useful in some applications.

While many devices operate best and perform more reliably when cooled to the extent practical, other devices such as Schottky rectifier are more efficient at a higher temperature but none the less must be kept below a maximum temperature limit. Other devices yet, such as certain ferrites or ceramic capacitors may have an optimum temperature for best operation even if a somewhat higher temperature is not destructive. In any of the fan assemblies with heat sink of the forgoing discussions a temperature sensitive feed back mechanism may be used to control the speed of the motor driving the fan. The fan can be driven more slowly if the temperature of the heat sink is less than optimum to allow the heat sink temperature to increase. As the optimum temperature is reached, the fan may operate at a faster speed to maintain the optimum temperature. The control could be linear, increasing the speed as the temperature increased, or it could be step-wise, for instance having a slow speed and a high speed.

In the foregoing discussions and the claims, "air" and "air stream" are used in a generic sense to mean a heat transporting fluid. The teachings of the invention would apply equally to any similar mechanism employing any fluid for heat transfer, compressible or incompressible. Likewise, "heat sink", "heat sinking" and "heat transfer into the air stream" are used in a generic sense (as that is the more common application), but heat transfer in either direction is contemplated by the invention and is equally applicable. In the foregoing discussions and the claims, "integral with" and "integral to" are not restricted to one piece items made from a single piece of material but also includes separate parts which are joined together by any means into an assembly such as by bonding, gluing, clamping, screwing, brazing, soldering, and so forth, the resulting assembly having good thermal contact and a low impedance thermal path between the parts thereof.

I claim:

1. A fan assembly with heat sink comprising:

a fan having a plurality of fan blades, means for rotating the fan so that air is moved within the fan assembly with heat sink, a fan duct having a wall with an inside and an outside surface surrounding the fan, the fan rotating within the fan duct with the plurality of fan blades of the fan proximate to the inside surface of the fan duct, at least one heat sink mounting surface integral to the fan duct for mounting a device to be cooled or heated, whereby the heat further being conducted from the fan duct to air which is moved within the fan assembly with heat sink, and whereby the conduction of heat is enhanced by the high velocity and turbulence of the air in the vicinity of the plurality of fan blades of the fan.

2. The fan assembly with heat sink of claim 1 further comprising at least one modifications to the fan to further increase the velocity and turbulence of the air in the vicinity of the fan proximate to the inside surface of the fan duct.

3. The fan assembly with heat sink of claim 2 further comprising:

a plurality of paddle bars located on the ends of the fan blades of the fan, the plurality of paddle bars being generally transverse to the rotation of the fan and further being proximate to and generally parallel with the inside surface of the fan duct, whereby the plurality of paddle bars further agitate the air in the vicinity of the fan blades in the inside of the fan duct for increased heat transfer from the fan duct to the air which is moved within the fan assembly with heat sink.

4. The fan assembly with heat sink of claim 3 wherein the plurality of paddle bars are air foils.

5. The fan assembly with heat sink of claim 3 wherein the fan blades are vestigial.

6. The fan assembly with heat sink of claim 2 wherein the modification to the fan comprises an increased pitch so that the fan operates in a stalled condition.

7. The fan assembly with heat sink of claim 1 further comprising a plurality of fins integral to the fan duct and the at least one heat sink mounting surface, whereby the plurality of fins supplements the transfer of heat from the fan duct to the air.

8. The fan assembly with heat sink of claim 7 further comprising a shroud enclosing the plurality of fins, the shroud further enclosing a portion of the outlet of the fan duct and the shroud further extending to the inlet of the fan duct, whereby a portion of the air which is moved within the fan assembly with heat sink is recirculated within the plurality of fins to enhance the transfer of heat and to reduce the volume of the air which exits the fan assembly with heat sink.

9. The fan assembly with heat sink of claim 1 further comprising a conduit for a fluid integral to the at least one heat sink mounting surface, whereby heat can be transferred from the fluid within the at least one heat sink mounting surface into the fan duct and then into the air moving within the fan assembly with heat sink.

10. The fan assembly with heat sink of claim 1 having an increased axial length whereby performance of the fan as an axial flow fan is decreased and the area of the inside surface of the fan duct is increased for increased heat transfer.

11. A fan assembly with heat sink comprising:

a fan comprising a plurality of paddle bars, means for rotating the fan so that air is moved within the fan assembly with heat sink, a fan duct having a wall with an inside and an outside surface surrounding the fan, the plurality of paddle bars being generally transverse to the rotation of the fan and further being proximate to and generally parallel with the inside surface of the fan duct, means for rotating the fan so that the paddle bars are rotated proximate to and generally parallel with the inside surface of the fan duct, at least one heat sink mounting surface integral to the fan duct for mounting a device to be cooled or heated, the heat further being conducted from the fan duct to air which is moved within the fan assembly with heat sink, and whereby the conduction of heat is enhanced by the high velocity and turbulence of the air in the vicinity of the plurality of paddle bars of the fan.

12. The fan assembly with heat sink of claim 11 wherein the plurality of paddle bars are air foils.

13. The fan assembly with heat sink of claim 12 wherein the angle of attack of the air foils of the plurality of paddle bars is alternatively positive and negative.

* * * * *